United States Patent [19]

Wessel et al.

[11] 3,999,527

[45] Dec. 28, 1976

[54] FUEL INJECTION SYSTEM

[75] Inventors: Wolf Wessel, Schwieberdingen; Wilfried Sautter, Ditzengen, Schockingen, both of Germany

[73] Assignee: Robert Bosch G.m.b.H., Stuttgart, Germany

[22] Filed: Feb. 20, 1975

[21] Appl. No.: 551,497

[30] Foreign Application Priority Data

Apr. 9, 1974 Germany ..... 2417129

[52] U.S. Cl. ..... 123/139 AW; 123/119 R

[51] Int. Cl.[2] ..... F02M 69/00

[58] Field of Search ..... 123/119 R, 139 AW

[56] References Cited

UNITED STATES PATENTS

| | | | |
|---|---|---|---|
| 3,730,155 | 5/1973 | Knapp | 123/119 R |
| 3,796,200 | 3/1974 | Knapp | 123/119 R |
| 3,867,917 | 2/1975 | Zeyns et al. | 123/119 R |

*Primary Examiner*—Charles J. Myhre
*Assistant Examiner*—Tony M. Argenbright
*Attorney, Agent, or Firm*—Edwin E. Greigg

[57] ABSTRACT

A fuel injection system includes a metering valve assembly whose control slide is actuated by the air flow through the induction tube and by an opposite restoring force provided by fluid pressure. The magnitude of this restoring force may be altered by the action of a pressure control valve. The back pressure downstream of this control valve and downstream of a main fuel system control valve is regulated by a back pressure regulating valve. This valve is responsive to signals related to the atmospheric pressure or to operating parameters of the engine, e.g., the induction manifold pressure and it regulates the back pressure of the fuel to maintain a desired fuel-air ratio.

11 Claims, 4 Drawing Figures

FUEL INJECTION SYSTEM

BACKGROUND OF THE INVENTION

The invention relates to a fuel injection system for mixture compressing, externally ignited internal combustion engines employing continuous fuel injection into the induction tube of the engine. The induction tube would typically contain an air flow measuring member as well as an arbitrarily actuatable butterfly valve, disposed in series, and the air flow measuring member is deflected corresponding to the air flow rate and in opposition to a restoring force. The moving air measuring member displaces the movable part of a valve in the fuel supply line which meters out a fuel quantity in proportion to the air flow rate. The restoring force is produced by a pressurized fluid which is supplied by a control pressure circuit and which exerts a constant but changeable pressure on the control slide. The control pressure changes are made by at least one electromagnetic valve which operates in dependence on operational engine parameters and at least one pressure control valve which, in particular, may contain a temperature-sensitive heatable valve element.

Fuel injection systems of this type are designed for automatically producing a favorable fuel-air mixture for all operational conditions of the internal combustion engine in order to provide complete fuel combustion, thereby preventing or greatly reducing the generation of toxic exhaust components while maintaining the highest possible power or the least possible fuel consumption of the internal combustion engine. To achieve complete combustion, the fuel must be metered out very precisely depending on the requirements of each operational state of the internal combustion engine and, further, it must be possible to change the fuel-air ratio in dependence on operational engine parameters such as, for example, rpm, load, temperature and exhaust gas composition.

In known fuel injection systems of this type, the fuel quantity is metered out as nearly proportionally as possible to the air quantity flowing through the induction tube and the ratio of the metered out fuel quantity to the air quantity can be altered by changing the magnitude of the restoring force acting on the air measuring member in dependence on engine parameters and by means of a pressure control valve and an electromagnetic valve. Such fuel injection systems require that the fuel system pressure, as regulated by a system pressure valve, is always maintained at the highest pressure required anywhere within the fuel injection system and hence the fuel supply pump and the pressure lines must be dimensioned correspondingly large.

OBJECT AND SUMMARY OF THE INVENTION

It is accordingly, a principal object of the invention to provide a fuel injection system of the known type in which the change of the fuel system pressure and of the pressure within the control pressure circuit can be made by simple means and in dependence on the operational parameters of the internal combustion engine.

This object is attained, according to the invention, by providing a back pressure control valve having a chamber which is connected to the downstream side of a pressure control valve, an electromagnetic valve and a system pressure control valve. The back pressure control valve is responsive to operational engine parameters and, by altering the back pressure, can change the fluid pressure in the control pressure circuit as well as the system pressure in the fuel supply circuit.

An advantageous feature of the invention provides that the control pressure fluid is engine fuel.

A further advantageous feature of the invention provides that the back pressure control valve is embodied as a flat seat valve, with a diaphragm as the movable valve member that is spring-loaded in the closing direction, the force of the spring being changeable in dependence on the operational parameters of the internal combustion engine. The other side of the diaphragm experiences the fuel pressure prevailing downstream of the pressure control valve, the electromagnetic valve and the system pressure control valve. The back pressure control valve may be so embodied that the force of the closing spring can be aided or opposed by a bellows-chamber in dependence on the atmospheric pressure, or, in yet another embodiment, in dependence on the induction tube pressure.

A further advantageous embodiment of the invention provides that the force of the spring acting on the diaphragm of the back pressure control valve is changeable by means of a cam plate connected to the butterfly valve shaft.

It is also be provided, in a preferred embodiment of the invention, that the system pressure regulating valve is a differential pressure valve embodied as a flat seat valve having a piston as its movable valve member, with the piston being actuated in the opening direction of the valve by the system pressure and in the closing direction by a spring and by the fuel pressure prevailing downstream of the system pressure control valve.

A related, preferred feature of the invention provides that the pressure control valve is embodied as a differential pressure valve having a diaphragm as the movable valve member which is actuated in the opening direction of the pressure control valve by the pressure of the pressurized medium in the control pressure circuit and is actuated in the closing direction by the pressure prevailing downstream of the pressure control valve and by a spring. The force of the spring may be opposed by a bi-metallic spring which acts as a temperature sensitive heatable control element when the engine temperatures are below the normal operating temperature.

Yet a further preferred feature of the invention provides that a fuel storage device is located in the control pressure circuit, in parallel with the pressure control valve for producing a hydraulic integration effect during pressure fluctuations. The electromagnetic valve is disposed downstream of this storage device which is embodied as a flat seat diaphragm valve. The diaphragm is actuated in the opening direction of the valve by the pressurized fluid in the control pressure circuit whereas it is actuated in the closing direction by a spring and the pressure prevailing downstream of the pressure control valve. The presence of the storage device makes it possible to regulate a lower pressure in the control pressure circuit if the electromagnetic valve is open than by means of the pressure control valve alone.

The invention will be better understood as well as further objects and advantages will become more apparent from the ensuing detailed specification of three preferred, although exemplary embodiments taken in conjunction with the drawing.

DESCRIPTION OF THE PREFERRED EMBODIMENTS

Figure 1:
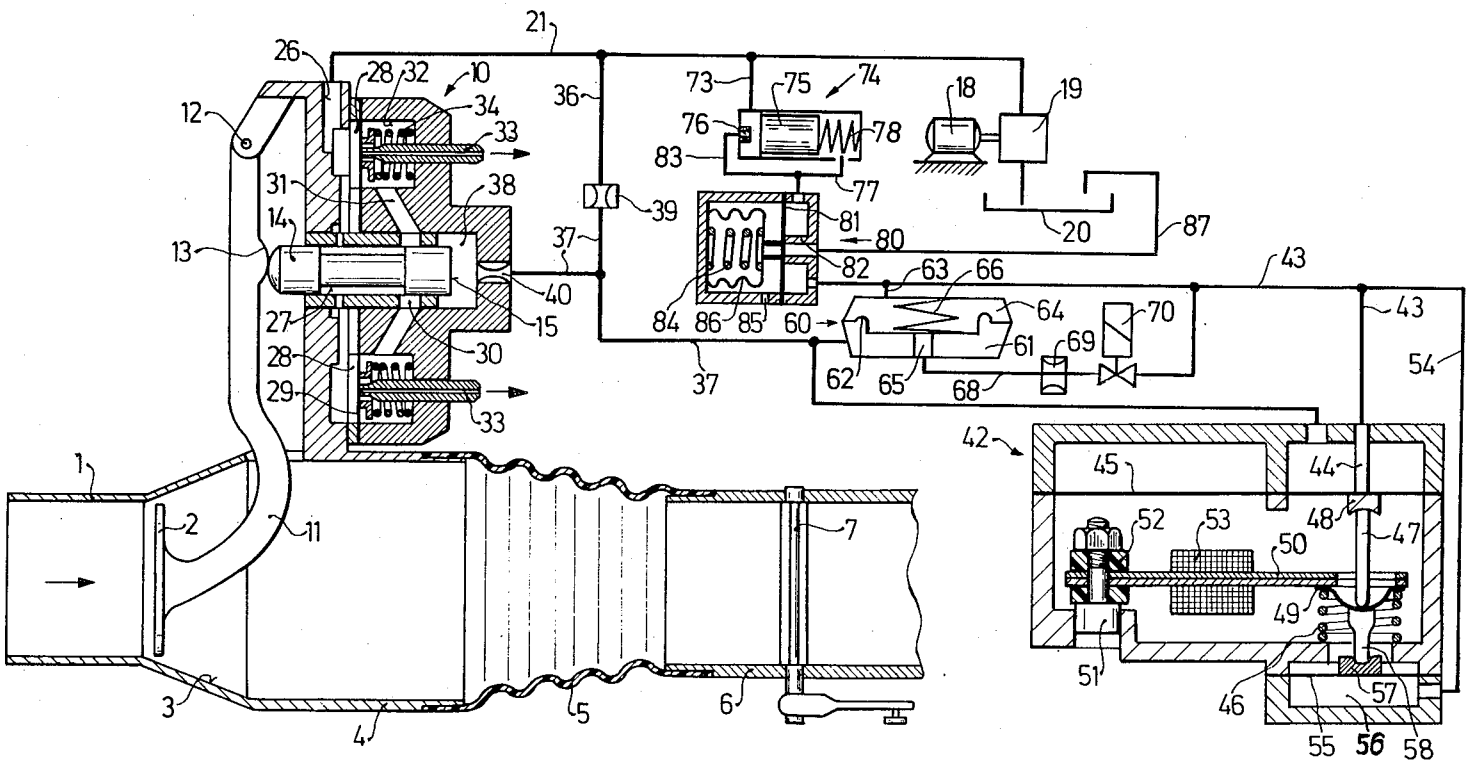
FIG. 1 is a partially sectional and partly schematic diagram of a fuel injection system according to a first exemplary embodiment of the invention.

Turning now to FIG. 1, we see a fuel injection system in which the combustion air flows in the direction of the arrow through an induction tube region 1 containing an air-flow measuring member 2 located in a conical tube region 3. The air then flows through an induction tube region 4 and a connecting hose 5 into an induction tube region 6 containing an arbitrarily actuatable butterfly throttle valve 7. The air then flows to one or several cylinders (not shown) of an internal combustion engine.

The air flow measuring member 2 is embodied as a plate disposed transversely with respect to the direction of flow and capable of an approximately linear motion within the conical region 3 of the induction tube as a function of the air flow rate. If the restoring force acting on the measuring member 2 as well as the air pressure prevailing ahead of it are both constant, then the pressure prevailing between the measuring member 2 and the butterfly valve 7 is also constant.

The measuring member 2 immediately moves to fuel metering and distribution valve 10. A lever 11 pivots in a location 12 and is directly connected to the measuring member 2 for transmitting its motions by means of a projection 13 to the control slide 14 of the fuel metering and distribution valve 10. The face 15 of the control slide 14 remote from the projection 13 is actuated by pressurized fluid which provides the restoring force for the measuring member 2.

Fuel is supplied by a fuel pump 19 driven by an electric motor 18 and it pumps fuel from a fuel storage container 20 and delivers it through a fuel supply line 21 to a channel 26 in the housing of the fuel metering and distribution valve 10. The channel 26 leads to an annular groove 27 in the control slide 14 which further communicates through several passages with chambers 28 defined by diaphragms 29 one side of which is, therefore, actuated by fuel pressure. Depending on the position of the control slide 14, the annular groove 27 more or less opens fuel control slits 30 each of which is connected through a channel 31 with a chamber 32 which is separated from the chamber 28 by the diaphragm 29. From the chambers 32, the fuel flows through the fuel injection channels 33 to the individual fuel injection valves of the engine, (not shown) which are located in the induction tube in the vicinity of the cylinders of the engine. The diaphragm 29 serves as the movable member of a flat seat valve which is held open by a valve spring 34 when the fuel injection system is not in operation. The diaphragm capsules, each of which is formed by a chamber 28 and a chamber 32, have the effect that the pressure gradient across the fuel metering valve means 27, 30 remains substantially constant independently of the amount of overlap between the annular groove 27 and the control slits 30 and thus also independently of the fuel quantity flowing to the injection valves. This constancy guarantees that the motion of the control slide 14 is proportional to the metered out fuel quantity. As the lever 11 pivots, the air measuring member 2 is moved into the conical regions 3 of the induction tube 1 and the annular flow cross-section formed between plate 2 and the conical region 3 of the induction tube changes in proportion to the motion of the measuring member 2.

The pressurized medium which produces the constant restoring force acting on the control slide 14 is engine fuel. In order to provide this restoring force, a line 36 branches off from the fuel supply line 21 and leads via a control pressure line 37 and a damping throttle 40 into a pressure chamber 38 of the metering valve assembly 10 into which the end of the control slide 14 remote from the lever 11 extends. A pre-throttle 39 uncouples the control pressure circuit 37 from the main fuel supply circuit leading to the fuel metering and distribution valve assembly 10.

The control pressure line 37 leads to a pressure control valve 42 through which the pressurized fluid may flow to a return flow line 43. The pressure control valve 42 can exert a temperature-dependent control over the pressure of the pressurized fluid creating the restoring force for the valve slide 14. The control valve 42 is embodied as a flat seat valve with a rigid valve seat 44 and a moving diaphragm 45 which is loaded in the closing direction of the valve by a spring 46. A pin 47 is clamped between a bearing block 48 on the diaphragm 45 and a spring support cup 49, permitting it to transmit the closing force of the spring 46 to the diaphragm 45. When the engine temperature lies below the nominal operational temperature, the spring 46 is opposed by a bi-metallic spring 50 acting via the spring support cup 49. The other end of the bi-metallic spring 50 is fastened to the housing of the pressure control valve 42 by a pressed-in bolt 51. A thermal insulating member 52, disposed between the bolt 51 and the bi-metallic spring 50 substantially insulates the bi-metallic spring against heat loss due to heat conduction to the housing of the pressure control valve.

An electric heating element 53 is mounted on the bi-metallic spring 50. Branching off from the fuel return line 43 is a line 54 leading to a second chamber 56 of the pressure control valve limited on one side by a second diaphragm 55. The side of the diaphragm 55 remote from the pressurized fluid inlet carries a bearing block 57 which supports a second force-transmitting pin 58 whose other end engages the spring support cup 49 and hence the pin 47.

Connected in parallel with the pressure control valve 42 is a storage device 60 including a storage chamber 61 separated by a diaphragm 62 from an opposite chamber 64 connected to the return line 43 by a line 63. The storage chamber 61 contains a fixed valve seat 65 from which the diaphragm 62 may be lifted by the control pressure prevailing in the storage chamber 61 and against the force of a spring 66 and of the return line pressure prevailing in the chamber 64. Downstream of the storage device 60, a line 68 includes a flow throttle 69 and an electromagnetic valve 70 and carries pressurized fluid into the return line 43 when the electromagnetic valve 70 is open.

Branching off from the fuel supply line 21 is a line 73 containing a fuel system pressure control valve 74 whose movable valve member is a piston 75 which cooperates with a fixed valve seat 76. The piston is actuated in the opening direction of the valve by the fuel pressure in the fuel supply line 21 and it is actuated in the closing direction of the valve by a spring 78 and by the fuel pressure prevailing downstream of the system pressure control valve 74 and admitted via a line 77.

Located downstream of the system pressure control valve 74 is a back pressure control valve 80 embodied as a flat seat valve with a diaphragm 81 and a fixed valve seat 82. In the opening direction of the back pressure control valve 80, the diaphragm 81 is actuated through a line 83 and through the line 43 by the back pressure prevailing downstream of the system pressure control valve 74, the pressure control valve 42 and the electromagnetic valve 70 and it is actuated in the closing direction by a spring 84 and by a pressure capsule 86 connected to atmospheric pressure through a bore 85. Fuel flowing over the valve seat 82 flows without pressure through a line 87 back to the fuel storage container 20.

The method of operation of the fuel injection system described above is as follows:

When the internal combustion engine is running, the fuel pump 19, driven by the electric motor 18, pumps fuel from the fuel storage container 20 and delivers it through the fuel supply line 21 to the fuel metering and distribution valve assembly 10. At the same time, the internal combustion engine aspirates air through the induction tube 1 and the flow of this air causes the measuring member 2 to deflect from its quiescent position. Corresponding to the deflection of the air measuring member 2, the lever 11 moves the control slide 14 which opens a greater flow cross-section of the control slits 30. The direct coupling between the measuring member 2 and the control slide 14 results in a constant ratio of the air quantity to the metered out fuel quantity provided that the characteristic operating curves of the two mechanical elements are both sufficiently linear which is a design goal.

As described so far, the fuel-air ratio would be constant over the entire operational domain of the internal combustion engine. However, the varying operational conditions of the engine necessitate making the fuel air mixture richer or leaner and this may be done by changing the restoring force acting on the air flow measuring member 2.

For this purpose, the control pressure circuit 37 contains the pressure control valve 42 which influences the pressure of the pressurized control fluid during the warm-up phase of the internal combustion engine and until such time as the engine reaches its nominal operating temperature, and thus it influences the enrichment of the fuel-air mixture in a temperature-dependent manner.

The closing force of the spring 46, transmitted by the pin 47 to the diaphragm 45, determines the effective control pressure in the circuit 37 while taking into account the pressure difference between the pressurized fluid upstream and downstream of the pressure control valve 42. However, when the temperature of the internal combustion engine lies below the nominal operating temperature, the bi-metallic spring 50 acts upon the spring support cup 49 to oppose the force of the spring 46, reducing the net valve closing force transmitted to the diaphragm 45. Immediately after the start of the engine, however, the electric heating element 53 heats up the bi-metallic spring and, as a consequence, the force transmitted from the bi-metallic spring 50 to the spring support cup 49 is reduced. The desired basic tension of the bi-metallic spring 50 can be set by pressing the bolt 51 into the housing of the pressure control valve 42 to varying depths.

The control pressure in the control pressure circuit 37 can also be altered in dependence on the operational parameters of the internal combustion engine by means of the electromagnetic valve 70 which is disposed downstream of the storage device 60 connected in parallel with the pressure control valve 42 and serving for hydraulic integration. The electromagnetic valve 70 lies in the line 58 and, when open, permits pressurized fluid to flow into the return line 43. In known manner, the electromagnetic valve 70 is controlled by an electric controller which receives signals from transducers that measure the pertinent operational parameters. For example, the control process may involve determining the oxygen content in the exhaust gas of the engine; in that case, a so-called oxygen sonde would be disposed in the exhaust line.

Another possibility for changing the control pressure in the control pressure circuit 37 is given by placing the back pressure control valve 80 in the return line 43.

For example, in the exemplary embodiment shown in FIG. 1, the closing force acting on the diaphragm 81 of the pressure control valve 80 is increased by the pressure capsule 86 when the atmospheric pressure decreases; this also increases the back pressure in the return line 43 and hence increases the control pressure in the control pressure circuit 37. Due to the increased control pressure, the control slide 14 is moved to a lesser extent by the air flow measuring member 2 and hence meters out a smaller fuel quantity via the metering valve means 27/30, so that the fuel quantity is adapted to the reduced air quantity resulting from the lower atmospheric pressure.

Since an increase in the control pressure in the control pressure circuit 37 requires that the fuel system pressure also be correspondingly increased, the back pressure control valve also simultaneously controls the back pressure of the fuel downstream of the system pressure control valve 74. In the present case, an increase of the back pressure produced by the back pressure control valve 80 in the lines 77, 83 simultaneously results in an increase of the system pressure in the fuel supply line 21. The embodiment of the fuel injection system which includes a back pressure control valve according to the invention offers the advantage that the fuel supply pump is working at maximum power only when an increased system pressure is required. Since the system pressure does not have to be maintained at high levels at all times, a smaller fuel pump may be used for fuel supply.

Figure 2:
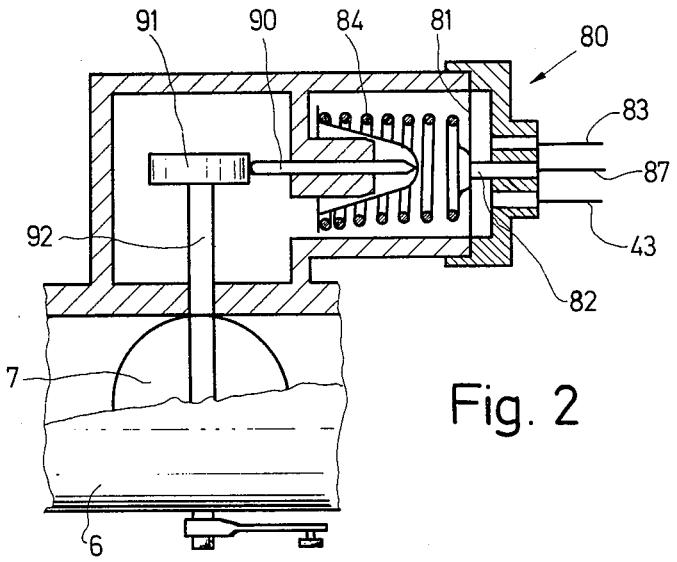
FIG. 2 is a partially sectional detail of a back pressure control valve according to a second exemplary embodiment of the invention.

In the second exemplary embodiment of the back pressure control valve 80, shown in FIG. 2, the closing force of the spring 84 may be augmented, in dependence on the position of the butterfly valve 7, by a cam plate 91 which is mounted on the shaft 92 of the butterfly valve and which is followed by a cam follower pin 90, acting on the spring 84 via a spring support.

Figure 3:
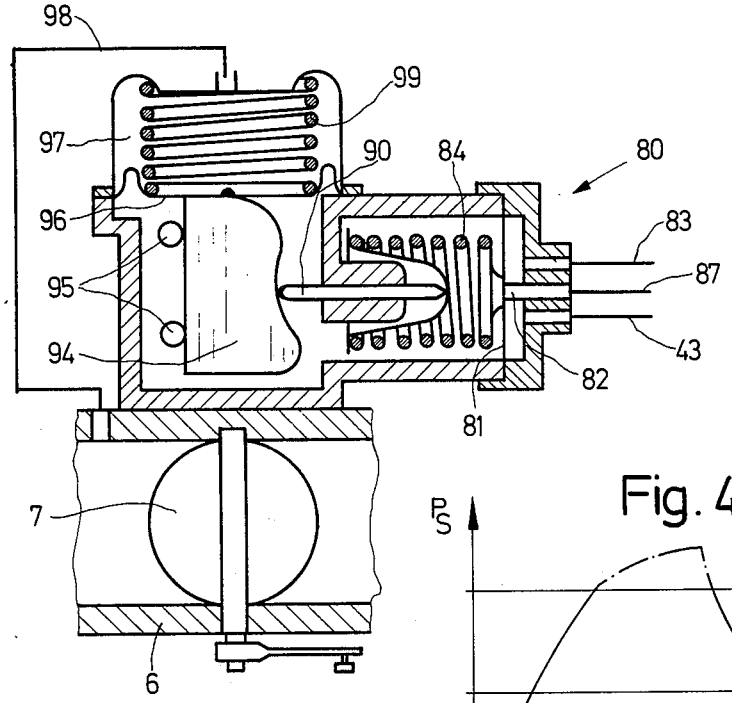
FIG. 3 is a sectional view of a back pressure control valve according to a third exemplary embodiment of the invention.

In the third exemplary embodiment of the back pressure control valve 80, shown in FIG. 3, the change of the spring force 84 is performed by means of the pin 90 which follows a cam plate 94 moving on rollers 95 and attached to a diaphragm 96. The diaphragm 96 is the movable member of a pressure chamber 97 which experiences induction tube pressure through a line 98. The pressure chamber 97 also contains a spring 99 acting on the diaphragm 96.

The adjustment of the fuel system pressure in dependence on the induction tube pressure, as described above, might be suitable, for example, in an internal combustion engine employing turbo-charging, where an increased fuel injection pressure may be required at the injection valve due to the increased induction manifold pressure.

Figure 4:
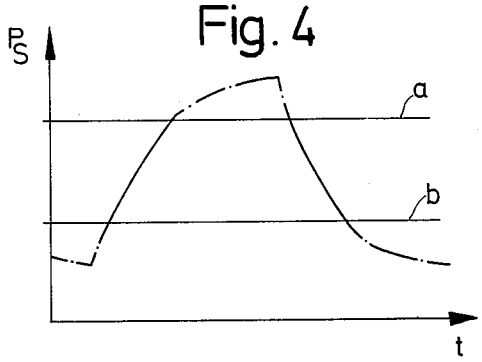
FIG. 4 is a diagram showing the pressure in the control pressure circuit as a function of time.

FIG. 4 is a diagram showing the control pressure $p_s$ as a function of the time t as a result of the hydraulic integration effect due to the storage device 60. The variation of the control pressure in the control pressure circuit 37 could be limited, for example, by maintaining the maximum possible control pressure, corresponding to the line a in FIG. 4, by means of the pressure control valve 42 and by maintaining the minimum possible control pressure, corresponding to the line b, by means of the storage device 60 when the electromagnetic valve 70 is open. This type of limitation of the control domain results in an approximately linear variation of the control pressure throughout the control domain even though it is inherently a non-linear function.

What is claimed is:

1. A fuel injection system for use with an internal combustion engine, comprising:

A. an air induction tube;

B. an air flow rate measuring member, disposed movably within said air induction tube;

C. an air throttling valve member, disposed downstream of said air flow rate measuring member within said induction tube;

D. a fuel metering and distributing valve assembly, including a movable fuel metering valve slide which is coupled to and actuated by said air flow rate measuring member, and which is subjected to a restoring pressure;

E. a primary fuel pump connected to said fuel metering and distributing valve;

F. a system pressure valve connected to said primary fuel pump, for regulating the pressure of the fuel delivered to said fuel metering and distributing valve;

G. a pressure control valve, connected to said fuel metering and distributing valve for controlling the restoring pressure applied to said valve slide and including a heatable, temperature sensitive control member;

H. an electromagnetic valve, connected to operate in association with said pressure control valve for controlling the restoring pressure applied to said valve slide and capable of accepting signals related to engine performance; and I. a back pressure control valve, including a valve chamber which is connected to the downstream side of said pressure control valve, said electromagnetic valve and said system pressure valve, and capable of regulating the pressure prevailing in said valve chamber.

2. A fuel injection system as defined in claim 1, wherein the restoring pressure applied to said valve slide in said fuel metering and distributing valve assembly is produced by engine fuel.

3. A fuel injection system as defined in claim 1, wherein said back pressure control valve includes a flat valve seat which may be obturated by a moving diaphragm, said valve further including a valve spring, disposed to load one side of said diaphragm in the sense of tending to close said valve seat, and means for changing the closing force applied by said valve spring to said disphragm, in dependence on signals related to engine parameters, whereas the other side of said diaphragm is loaded, in the sense of tending to open said valve seat, by the fluid pressure prevailing downstream of said pressure control valve, said system pressure valve and said electromagnetic valve.

4. A fuel injection system as defined in claim 3, wherein said means for changing the closing force applied by said valve spring is a pressure capsule which is responsive to atmospheric pressure.

5. A fuel injection system as defined in claim 3, wherein said means for changing the closing force applied by said valve spring includes a cam, mounted on the shaft of said air throttling valve member, and cam follower means, connected to said valve spring.

6. A fuel injection system as defined in claim 3, wherein said means for changing the closing force applied by said valve spring includes a pressure capsule which is responsive to the induction tube pressure.

7. A fuel injection system as defined in claim 1, wherein said system pressure valve is a differential pressure valve.

8. A fuel injection system as defined in claim 7, wherein said system pressure valve includes a flat valve seat and a moving piston which cooperates with and is capable of closing said valve seat, and a spring which loads said piston in the sense of tending to close said valve seat, the system pressure valve being so connected that it tends to be opened by the pressure of the fuel delivered to said fuel metering and distributing valve.

9. A fuel injection system as defined in claim 1, wherein said pressure control valve is a differential pressure valve including a flat valve seat and a movable diaphragm which cooperates with and is capable of closing said valve seat, and a valve spring which mediately loads said diaphragm in the sense of tending to close said valve seat, and wherein said temperature-sensitive control member is a bi-metallic spring so disposed as to be able to alter the loading force exerted by said valve spring on said diaphragm.

10. A fuel injection system as defined in claim 1, further comprising:

J. a fuel storage device, connected in fluid series connection with said electromagnetic valve and connected in fluid parallel connection with said pressure control valve.

11. A fuel injection system as defined in claim 10, wherein said fuel storage device is a valve, including a flat valve seat and a movable diaphragm, capable of cooperating with and closing said valve seat, and a valve spring, disposed to load one side of said diaphragm in the sense of tending to close said valve seat, whereby, when said electromagnetic valve is open, said fuel storage device is capable of lowering the restoring pressure applied to said valve slide in said fuel metering and distributing valve assembly.

* * * * *